US011732862B2

(12) United States Patent
Sasaki et al.

(10) Patent No.: US 11,732,862 B2
(45) Date of Patent: Aug. 22, 2023

(54) INDICATOR LAMP, VEHICLE INDICATOR LAMP WITH SAID INDICATOR LAMP, VEHICLE EXTERIOR MEMBER, AND VEHICLE

(71) Applicants: NISSAN MOTOR CO., LTD., Yokohama (JP); MITSUBISHI CHEMICAL CORPORATION, Tokyo (JP)

(72) Inventors: Yu Sasaki, Kanagawa (JP); Tatsuomi Nakayama, Kanagawa (JP); Yusuke Hirata, Kanagawa (JP); Takao Marutani, Tokyo (JP); Tadayoshi Sawada, Tokyo (JP)

(73) Assignees: NISSAN MOTOR CO., LTD., Yokohama (JP); MITSUBISHI CHEMICAL CORPORATION, Tokyo (JP)

( * ) Notice: Subject to any disclaimer, the term of this patent is extended or adjusted under 35 U.S.C. 154(b) by 0 days.

(21) Appl. No.: 17/762,163

(22) PCT Filed: Jul. 30, 2020

(86) PCT No.: PCT/JP2020/029287
§ 371 (c)(1),
(2) Date: Mar. 21, 2022

(87) PCT Pub. No.: WO2021/059740
PCT Pub. Date: Apr. 1, 2021

(65) Prior Publication Data

US 2022/0364704 A1 Nov. 17, 2022

(30) Foreign Application Priority Data

Sep. 24, 2019 (JP) ..... 2019-172738

(51) Int. Cl.
*F21S 43/20* (2018.01)
*F21S 43/14* (2018.01)

(52) U.S. Cl.
CPC ..... *F21S 43/20* (2018.01); *F21S 43/14* (2018.01)

(58) Field of Classification Search
CPC ..... F21S 43/16; F21S 43/14
See application file for complete search history.

(56) References Cited

U.S. PATENT DOCUMENTS

2020/0041885 A1* 2/2020 Peeters ..... G02B 6/0003
2020/0208802 A1* 7/2020 Lin ..... F21V 3/04
2021/0046738 A1* 2/2021 Izu ..... B60J 1/001

FOREIGN PATENT DOCUMENTS

JP 2000-149615 A 5/2000

OTHER PUBLICATIONS

Anonymous, XP055970932, URL:https://asset.conrad.com/media 1 0/add/160267 /c1 /-/gl/000183434OS01 /datenblatt-183434-mentor-26718001-leuchtkappe?transparent-passend-fuer-leds-led-5-mm-lampe-5-mm.pdf, alleged to be retrieved from the internet on Oct. 13, 2022.

(Continued)

*Primary Examiner* — Eric T Eide
(74) *Attorney, Agent, or Firm* — Foley & Lardner LLP

(57) ABSTRACT

An indicator lamp of the present invention includes a lamp body, a light source unit disposed inside the lamp body, and a light transmissive resin member disposed at a position for transmitting light that is emitted from the light source unit and for outputting the light from the lamp body.
The light source unit emits red light having a maximum value of light intensity at a wavelength of 600 nm or longer and 700 nm or shorter. The light transmissive resin member has an L* value of 35 or less, a transmittance of light having a wavelength of 675 nm of 90% or greater and a total light (Continued)

transmittance of 5% or greater in the state in which an optical path length of transmitting light is 2 mm. This configuration provides an indicator lamp with excellent design that shows its presence by showing a red chromatic tone when a light source is turned on and that shows a black color tone when the light source is turned off.

15 Claims, 4 Drawing Sheets

(56) References Cited

OTHER PUBLICATIONS

Anonymous: "1 ", XP055970983, alleged to be retrieved from the internet on Oct. 13, 2022.

Anonymous: "Colorizer—Color Picker and Converter (RGB HSL HSB/HSV CMYK HEX Lab)," XP055970935, URL:https://colorizer.org/, alleged to be retrieved from the internet on Oct. 13, 2022.

Anonymous: "Light-Emitting Diode—Wikipedia", XP055947065, URL:https://en.wikipedia.org/w/index.php?title=Light? emitting_diode&oldid=574596129.

Anonymous: "Mentor 2671.8001 Leuchtkappe Transparent Passend fur (LEDs) LED 5 mm, Lampe 5 mm kaufen", XP055970930, URL:https://www.conrad.de/de/p/mentor-2671-8001-leuchtkappe?transparent-passend-fuer-leds-led-5-mm-lampe-5-mm-183434.html, alleged to be retrieved on Oct. 13, 2022.

ISO 11664-4:2008 Colorimetry—Part 4: CIE 1976 L*a*b* Colour Space, International Standard—ISO, Zuerich, CH, vol. 11664-4, No. 1st ed, (Nov. 1, 2008), XP009125830.

ISO 13468-2 Plastics—Determination of the Total luminous Transmittance of Transparent Materials—Part 2: Double-beam instrument, International Standard ISO/IEC, XX, XX, (May 1, 1999), XP009158647.

* cited by examiner

INDICATOR LAMP, VEHICLE INDICATOR LAMP WITH SAID INDICATOR LAMP, VEHICLE EXTERIOR MEMBER, AND VEHICLE

TECHNICAL FIELD

The present invention relates to an indicator lamp, a vehicle exterior member including the vehicle indicator lamp, and a vehicle including the vehicle exterior member, and in more detail, relates to an indicator lamp that can be used for a tail lamp of an automobile, or the like.

BACKGROUND ART

Rear combination lamps, which are a combination of a direction indicator lamp and a stop tail lamp, and so on, are mounted to the rears of automobiles.

This rear combination lamp includes a light source for the direction indicator lamp and a light source for the stop tail lamp that are disposed inside a lamp body covered with a transparent cover.

An orange transparent cover is disposed to the direction indicator lamp part of the rear combination lamp so that orange (amber)-colored light will be emitted to the outside. A red transparent cover is disposed to the stop tail lamp so that red-colored light will be emitted to the outside.

For such conventional rear combination lamps, there is a demand for a mono-colored part that is visible from the outside, and a lamp with the whole transparent cover being visible in monochrome has been desired.

Patent Document 1 discloses a mono-colored lamp including an orange light-emitting diode (LED) and an incandescent light bulb inside a red transparent cover. This mono-colored lamp emits red light that is colored by the red transparent cover in response to turning on the incandescent light bulb, in which the emission light wavelength region is wide. The mono-colored lamp emits orange light in response to turning on the orange LED, which emits monochromatic light.

CITATION LIST

Patent Document

Patent Document 1: JP 2000-149615A

SUMMARY OF INVENTION

Technical Problem

In the midst of increasing demand for more well-designed vehicles in recent years, the mono-colored lamp disclosed in Patent Document 1 is visible in red not only when the light source is turned on but also when the light source is turned off, and it has a high presence on the exterior of a vehicle, causing reduction in the degree of freedom of vehicle design.

If indicator lamps, such as tail lamps or rear combination lamps, are black, the design of a vehicle can be improved by eliminating the presence of the indicator lamps, making a joint inside the indicator lamps and a step on a surface of the indicator lamps less noticeable, and so on. However, due to their function, indicator lamps are required to show their presence by showing a red color tone when the light source is turned on.

The present invention has been made in view of these problems in existing techniques, and an object of the present invention is to provide an indicator lamp with excellent design that shows its presence by showing a red chromatic tone when a light source is turned on and that eliminates its presence by showing a black color tone when the light source is turned off.

Solution to Problem

The inventors have conducted an intensive study in order to achieve the above object, and they have found that a combination of a black light transmissive resin member for transmitting red light and a light source for emitting red light enables achieving the above object. Thus, the present invention has been completed.

That is, an indicator lamp of the present invention includes a lamp body, a light source unit disposed inside the lamp body, and a light transmissive resin member disposed at a position for transmitting light that is emitted from the light source unit and for outputting the light from the lamp body.

The light source unit is configured to emit red light having a maximum value of light intensity in a wavelength range of 600 to 700 nm. The light transmissive resin member has an L* value of 35 or less, a transmittance of light having a wavelength of 675 nm of 90% or greater in a state in which an optical path length of transmitting light is 2 mm, and a total light transmittance of 5% or greater in the state in which an optical path length of transmitting light is 2 mm.

A vehicle indicator lamp of the present invention is the indicator lamp.

Moreover, a vehicle exterior member of the present invention includes the vehicle indicator lamp.

In addition, a vehicle of the present invention includes the vehicle indicator lamp or the vehicle exterior member.

Advantageous Effects of Invention

The present invention uses a combination of the light transmissive resin member and a red light source. The light transmissive resin member has an L* value of 35 or less, and a transmittance of light having a wavelength of 675 nm of 90% or greater and a total light transmittance of 5% or greater in the state in which an optical path length of transmitting light is 2 mm. The red light source has a maximum value of light intensity at a wavelength of 600 nm or longer and 700 nm or shorter. This configuration provides an indicator lamp with excellent design that shows its presence by showing a red chromatic tone when a light source is turned on and that shows a black color tone when the light source is turned off.

DESCRIPTION OF EMBODIMENTS

<Indicator Lamp>

An indicator lamp of the present invention will be described in detail.

The indicator lamp of the present invention includes a lamp body, a light source unit disposed inside the lamp body, and a light transmissive resin member disposed at a position for transmitting light that is emitted from the light source unit and for outputting the light from the lamp body.

Figure 1:
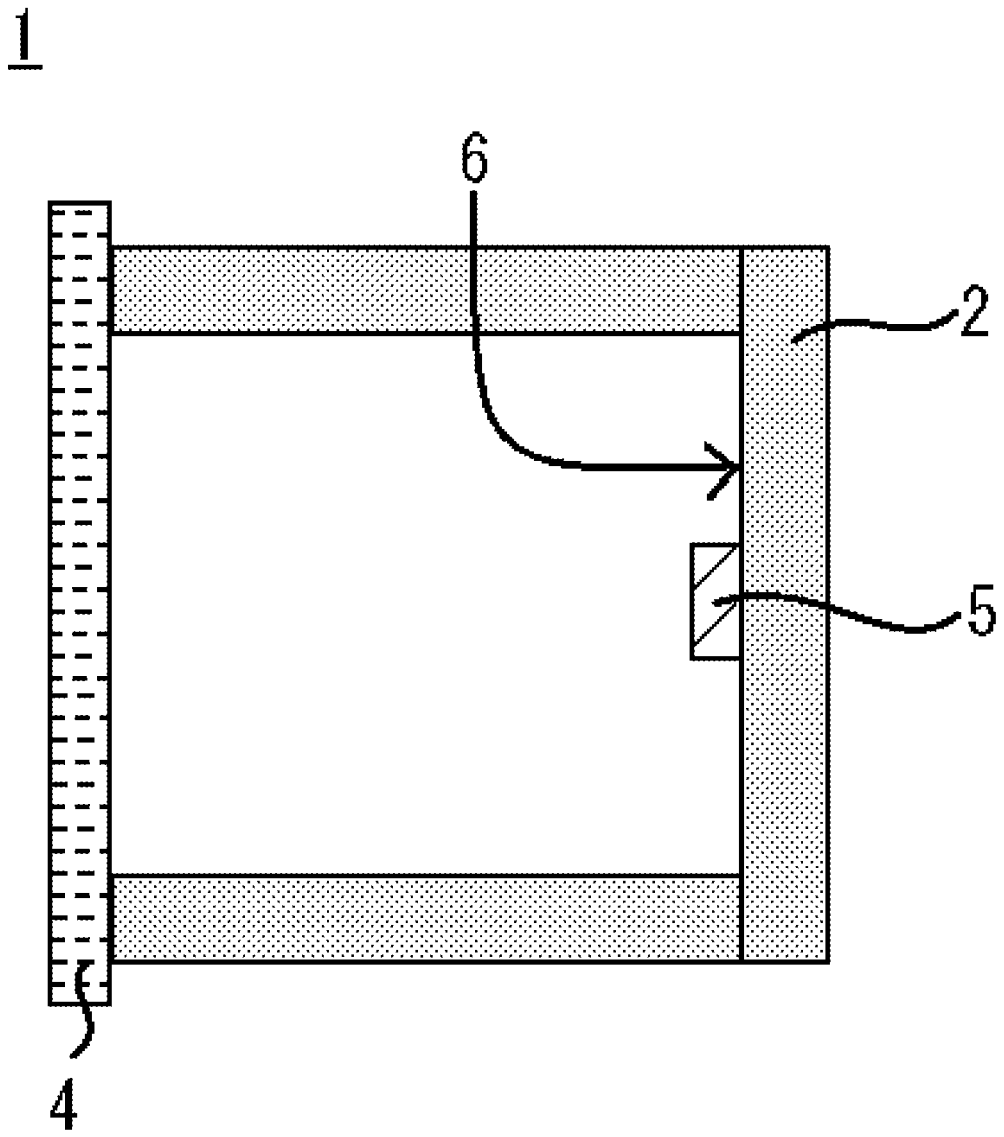
FIG. 1 is a schematic sectional view of an indicator lamp having a light transmissive resin member as an outer cover.
Figure 2:
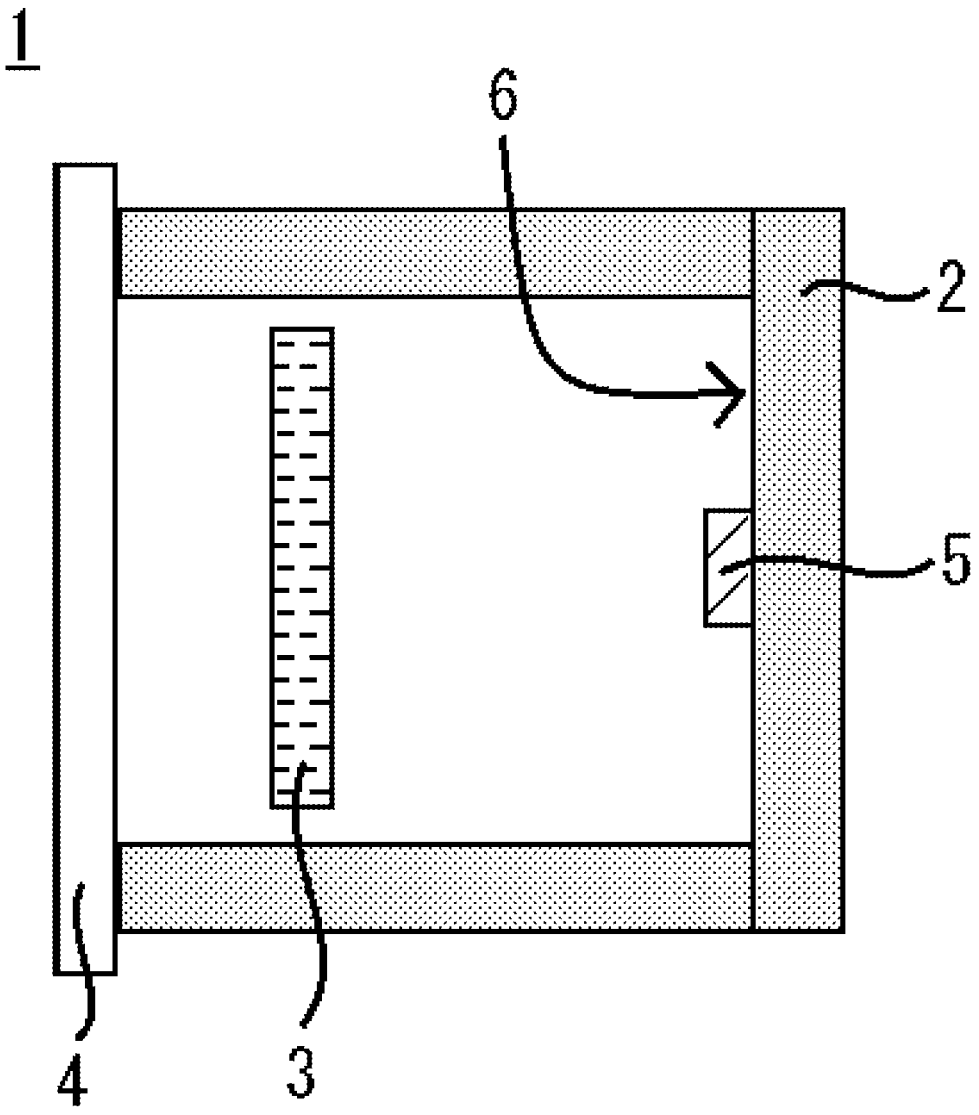
FIG. 2 is a schematic sectional view of an indicator lamp having an outer cover and an inner lens.

The light transmissive resin member is an inner lens 3 or an outer cover 4, which will be described later. As illustrated in FIGS. 1 and 2, in an indicator lamp 1, a lamp chamber is formed of a lamp body 2 with a forward opening, and a light transmissive resin member disposed at the opening of the lamp body. A light source unit 5 is disposed in the lamp chamber of the indicator lamp.

The light source unit is a light source that emits red light having a maximum value of light intensity at a wavelength of 600 nm or longer and 700 nm or shorter. The light transmissive resin member has an L*value of 35 or less and a transmittance of light having a wavelength of 675 nm of 90% or greater in a state in which an optical path length of transmitting light is 2 mm. The transmittance of light having a wavelength of 675 nm is 90% or greater in the state in which an optical path length of transmitting light is 2 mm. This is not intended to limit the thickness of the light transmissive resin to 2 mm, but specifies the value that is a result of measuring a transmittance of light having a wavelength of 675 nm in the state in which an optical path length of transmitting light is 2 mm.

The red light that is emitted from the light source unit is transmitted through the light transmissive resin member and is then emitted from the lamp body. As a result, this indicator lamp emits light in red tone due to the red light combined with the light transmissive resin member for transmitting red light, in response to turning on the light source unit. Thus, the presence of the indicator lamp can be effectively perceived by a viewer.

In contrast, when the light source unit is turned off, the indicator lamp itself is less noticeable from a person viewing the indicator lamp, because of the blackish color of the light transmissive resin member.

That is, the indicator lamp drastically varies in color tone of the appearance from a black color to a red color and exerts functions as an indicator lamp in response to turning on the light source, whereas it shows a black color and inhibits a viewer from perceiving its presence, in response to turning off the light source. Thus, a joint inside the indicator lamp and a step on a surface of the indicator lamp are less noticeable, which improves the degree of freedom of vehicle design, whereby a new appearance having an unusual originality or attractiveness can be achieved.

<Light Transmissive Resin Member>

The light transmissive resin member has a transmittance of light having a wavelength of 675 nm of 90% or greater, at an optical path length of 2 mm. When the light source is turned on, the light transmissive resin member, which has a transmittance of light of 90% or greater, transmits a sufficient amount of light in a red wavelength region and shows a red chromatic tone with high brightness, whereby good noticeability is provided.

The light transmissive resin member has an L* value for reflection light of 35 or less. The light transmissive resin member, which has an L* value for reflection light of 35 or less, shows a black color when the light source is turned off. The L* value of the light transmissive resin member is preferably 30 or less, preferably 29.5 or less, and more preferably 27 or less. The small L* value increases jet-blackness and reduces the presence, resulting in providing a good design.

In the present invention, the L* value for reflection light is calculated from tristimulus values X, Y, and Z that are measured by spectrophotometric colorimetry (integrating sphere method, reflection measurement) in conformity with ISO 11664-4.

The light transmissive resin member has a lower limit of a total light transmittance of 5% or greater in the state in which an optical path length of transmitting light is 2 mm.

Due to the light transmissive resin member having a total light transmittance of 5% or greater, the hue of light that is transmitted through the light transmissive resin member is visually observed, and the indicator lamp shows a vivid red color tone when the light source is turned on. The lower limit of the total light transmittance is more preferably 6% or greater.

In the light transmissive resin member, the upper limit of the total light transmittance at an optical path length of 2 mm is not specifically limited, but it is preferably 10% or less, and more preferably 7% or less.

Due to the light transmissive resin member having a total light transmittance of 10% or less, light that is emitted from the outside, such as sunlight, is prevented from entering and brightly illuminating the inside of the indicator lamp. Thus, jet-blackness of the indicator lamp is improved.

The total light transmittance as a transmittance of light in a visible light wavelength region can be measured in conformity with ISO 13468-1.

The light transmissive resin member preferably satisfies the following Formulas (1) to (3).

$$T_{600} \leq 10\% \quad \text{Formula (1)}$$

$$T_{610} \leq 25\% \quad \text{Formula (2)}$$

$$T_{\alpha} \leq 3.0\% \quad \text{Formula (3)}$$

Note that, in the Formulas (1) to (3), the symbols "$T_{600}$" and "$T_{610}$" represent light transmittances at wavelengths of 600 nm and 610 nm, respectively, and the symbol "Ta" represents a maximum value of transmittance of light in a wavelength range of 380 nm or longer and shorter than 580 nm.

The light transmissive resin member, which satisfies the Formulas (1) to (3), has a small transmittance of orange light having a wavelength shorter than 610 nm and transmits red light. As a result, the indicator lamp of the present invention has a jet-black color when the light source is turned off and shows a vivid red color tone with no yellowish tint in response to turning on the light source.

In addition, the light transmissive resin member preferably satisfies the following Formula (4).

$$T_{625} \geq 45\% \quad \text{Formula (4)}$$

Note that, in the Formula (4), the symbol "$T_{625}$" represents a light transmittance at a wavelength of 625 nm.

The light transmissive resin member, which satisfies the Formula (4), enables using not only expensive red LEDs that show a maximum intensity value at a wavelength of 630 nm or longer, but also inexpensive red LEDs that show a maximum light intensity value at a wavelength of 620 nm or 625 nm, as the light source unit.

In the present invention, a transmittance of visible light in a wavelength region of 380 nm or longer and 780 nm or shorter is measured as follows: light is transmitted from a back surface of the light transmissive resin member, and the transmitted light is measured from a surface side of the light transmissive resin member by using a spectrophotometer.

The light transmissive resin member can be formed by coloring transparent resin with a colorant.

Yellow to red colorants that have a low absorbance for light in a wavelength range of 610 nm or longer and that transmit red light can be used as the colorant.

The lower limit of a total amount in the light transmissive resin member of yellow to red colorants that have a maximum absorbance value at 435 nm or longer and 500 nm or shorter is not specifically limited. However, although depending on the type of colorant, etc., it is preferably 0.005 parts by mass or more per 100 parts by mass of transparent resin, from the point of view of improvement in jet-blackness. The upper limit of the amount of the yellow to red colorants is not specifically limited.

However, from the point of view of transmitting a sufficient amount of light in a red wavelength region to show a red chromatic tone with high brightness and provide good visibility when the light source is turned on, it can usually be 2.0 parts by mass or less per 100 parts by mass of transparent resin.

The amount of the yellow to red colorants in the light transmissive resin can be appropriately set in accordance with a well-known technique by a person skilled in the art, so that the lightness (L*) of an obtained light transmissive resin and the total light transmittance will be desired values.

Note that the amount of a colorant having an absorbance at a wavelength of 610 nm or to longer should be carefully considered.

The light transmissive resin member preferably contains two or more types of colorants having wavelengths that differ from each other in maximum absorbance value. Adding a purple to greenish blue colorant, in addition to the yellow to red colorant, enables uniformly absorbing light having a wavelength of 380 nm or longer and 605 nm or shorter, resulting in improvement in jet-blackness.

In general, a purple to greenish blue colorant having a maximum absorbance value at a wavelength of 560 nm or longer and 605 nm or shorter has an absorbance at a wavelength of 610 nm or longer. In view of this, a colorant having a transmittance of light of a wavelength of 610 nm or longer is selected, and the amount of this colorant is adjusted. This makes it possible to efficiently absorb light of a wavelength of shorter than 610 nm to reduce the L* value, whereby jet-blackness can be improved.

The two or more types of the colorants preferably satisfy the following Formulas (5) to (6).

$$\lambda(i+1)-\lambda(i)<180 \quad \text{Formula (5)}$$

$$480\leq\lambda(n)\leq600 \quad \text{Formula (6)}$$

Note that, in the Formulas (5) and (6), assuming that a wavelength showing a maximum absorbance value of n types of colorants contained in a resin lens has a relationship "$\lambda(1)<\lambda(2)< \ldots <\lambda(n)$" in a visible light wavelength range of 380 nm or longer and 780 nm or shorter, the symbol "$\lambda(i)$" represents a wavelength (unit: nm) at which an i-th colorant shows a maximum absorbance value, and "n" is an integer of 2 or more.

Multiple colorants that show maximum absorbance values at different wavelengths are contained, and an interval between maximum absorbance values of colorants having adjacent maximum absorbance values satisfies the Formula (5). This enables sufficiently absorbing light having a small interval between maximum absorbance values and having a wavelength shorter than that of red light, whereby a vivid red color tone with no yellowish tint nor bluish tint can be shown.

The value "$\lambda(i+1)-\lambda(i)$" is preferably less than 180, more preferably less than 140, and further preferably less than 100. The lower limit of the value "$\lambda(i+1)-\lambda(i)$" is not specifically limited, but it is usually 20 or more.

The wavelength at which the absorbance is maximum, of a colorant having a maximum absorbance value at the longest wavelength among two or more types of colorants, satisfies the Formula (6). This makes it possible to cut off light in a yellow wavelength region but transmit light in a red wavelength region, whereby a vivid red chromatic tone can be shown when the light source is turned on. The $\lambda(n)$ is preferably 480 nm or longer and 600 nm or shorter, more preferably 500 nm or longer and 600 nm or shorter, and further preferably 520 nm or longer and 600 nm or shorter.

Although depending on the type of colorant, etc., the amount of the colorant having a maximum absorbance value at the longest wavelength in the light transmissive resin member is preferably 2.0 parts by mass or less per 100 parts by mass of transparent resin. This comes from the point of view of transmitting a sufficient amount of light in a red wavelength region to show a red chromatic tone with high brightness and provide good visibility when the light source is turned on.

The amount of the colorant in the light transmissive resin can be appropriately set in accordance with a well-known technique by a person skilled in the art, so that the lightness (L*) of an obtained light transmissive resin and the total light transmittance will be desired values.

Examples of the colorants include anthraquinone dyes, perinone dyes, quinacridone dyes, methine dyes, azo dyes, and quinophthalone dyes.

Examples of yellow to red anthraquinone dyes include Solvent Red 52, Solvent Red 111, and Disperse Red 22.

Examples of yellow to red perinone dyes include Solvent Orange 60, Solvent Red 135, Solvent Red 179, and Pigment Red 149.

An example of yellow to red quinacridone dyes includes Pigment Red 122.

Examples of yellow to red methine dyes include Solvent Orange 107 and Solvent Yellow 179.

Examples of yellow to red quinophthalone dyes include Solvent Yellow 33, Disperse Yellow 54, and Disperse Yellow 160.

Among these colorants, anthraquinone dyes and perinone dyes have excellent weather resistance and are thus preferably used.

Examples of the purple to greenish blue colorant include Disperse Violet 28, Solvent Violet 13, Solvent Violet 36, Solvent Blue 87, Solvent Blue 94, Solvent Blue 97, Solvent Green 3, and Solvent Green 28.

Thermoplastic resin that shows a high light transmittance in a visible light region and that has excellent heat resistance and weather resistance, can be used as the transparent resin. Thermoplastic resin has excellent formability and is easy to form into a complicated shape, and thus, it enables forming a light transmissive resin member having a complicated shape, such as an inner lens or an outer cover, which will be described later.

Examples of the thermoplastic resin include methacrylic resin, polycarbonate resin, and polystyrene resin.

These thermoplastic resins are light in weight compared with glass and have an excellent balance of transparency, weather resistance, mechanical characteristics, and formability, among industrialized synthetic resins, and thus, they are preferably used. Among them, methacrylic resin has excellent transparency, weather resistance, and impact resistance and is thereby suitable for use in a vehicle exterior member, a lighting lamp cover, and an indication plate.

The thermoplastic resin can contain additives such as impact modifier, mold release agent, ultraviolet absorber, polymerization inhibitor, antioxidant, and flame retardant, as necessary.

(Methacrylic Resin)

Examples of the methacrylic resin include homopolymer of methyl methacrylate (hereinafter abbreviated as "MMA") and MMA copolymer that contains a repeating unit derived from MMA (hereinafter abbreviated as "MMA unit") in an amount of 70 mass % or more and less than 100 mass % per total mass of the methacrylic resin.

The MMA copolymer contains MMA, 70 mass % or more and less than 100 mass % of the MMA unit, and more than 0 mass % and 30 mass % or less of a repeating unit derived from another monomer described below (hereinafter abbreviated as "another monomer unit").

The another monomer is not specifically limited on the condition that it can be copolymerized with MMA. Examples of the another monomer include publicly known (meth)acrylic ester compounds, such as methyl acrylate, ethyl (meth)acrylate, and n-butyl (meth)acrylate, and publicly known aromatic vinyl compounds, such as styrene and α-methylstyrene.

Examples of commercial products of the methacrylic resin include ACRYPET (registered trademark) VH, MD, MF, IRK304, and VRL40 (each which is a trade name, manufactured by Mitsubishi Chemical Corp.).

(Polycarbonate Resin)

Examples of the polycarbonate resin include products obtained by reaction of publicly known dihydric phenol and publicly known carbonylating agent by an interfacial polycondensation method, a melt ester exchange method, or the like, products obtained by polymerizing a publicly known carbonate prepolymer by a solid phase ester exchange method or the like, and products obtained by polymerizing a publicly known cyclic carbonate compound by a ring-opening polymerization method.

Examples of commercial products of the polycarbonate resin include Panlite series (trade name, manufactured by Teijin Chemicals Ltd.), Iupilon series (trade name, manufactured by Mitsubishi Engineering-Plastics Corp.), SD POLYCA series (trade name, manufactured by Sumitomo Dow Ltd.), CALIBRE (trade name, manufactured by The Dow Chemical Co.), CZ series and PCZ series (trade name, manufactured by Mitsubishi Gas Chemical Co., Inc.), and APEC series (trade name, manufactured by Bayer AG).

(Polystyrene Resin)

Examples of the polystyrene resin include homopolymers of styrene (hereinafter abbreviated as "Si") and styrene copolymers that contain a repeating unit derived from St (hereinafter abbreviated as "St unit") in an amount of 50 mass % or more and less than 100 mass % per total mass of the polystyrene resin.

Specific examples of the polystyrene resin include polystyrene-based resin, styrene-acrylonitrile resin, transparent acrylonitrile-butadiene-styrene resin (transparent ABS resin), and methyl methacrylate-styrene resin (MS resin). Methyl methacrylate-styrene resin is preferable.

Examples of commercial products of the polystyrene-based resin include PSJ Polystyrene and ET series (trade name, manufactured by PS Japan Corp.). In addition, examples of commercial products of the MS resin include estyrene MS series (trade name, manufactured by Nippon Steel & Sumikin Chemical Co., Ltd.), and CEVIAN MAS series and MAS series (trade name, manufactured by Daicel Polymer Co., Ltd.).

(Outer Cover)

The outer cover mechanically protects the light source unit and so on from flying substances such as small pebbles, insects, tree branches, etc., while the vehicle is traveling.

(Inner Lens)

The inner lens is provided between the outer cover and the light source unit, and it diverges or converges light emitted from the light source unit, to improve visibility of the indicator lamp.

In the case in which the indicator lamp of the present invention includes the outer cover and the inner lens, one or each of the outer cover and the inner lens is a black-colored light transmissive resin member that transmits red light.

The indicator lamp of the present invention may not have the inner lens. The indicator lamp without the inner lens has an outer cover made of a light transmissive resin member, and this outer cover may be an outer lens having a lens function.

An outer cover or an inner lens that is not a light transmissive resin member can be made of transparent resin that is the same as or similar to the thermoplastic resin used in the light transmissive resin member, and they may be colorless and transparent.

<Light Source Unit>

The light source unit is a light source that emits red light having a maximum value of light intensity in a wavelength range of 600 nm or longer and 700 nm or shorter.

The red light, which is emitted from the light source unit, is positioned inside the lamp body, and it is transmitted through the light transmissive resin member and is output from the indicator lamp. Thus, the indicator lamp shows a red color tone and enables a viewer to perceive its presence.

The light source unit preferably has a maximum value of light intensity in a wavelength region in which the transmittance of the light transmissive resin member is 60% or greater. Due to emission of light having a maximum value of light intensity in the wavelength region in which the transmittance of the light transmissive resin member is 60% or greater, the light source unit makes the indicator lamp emit light with high brightness, whereby the presence of the indicator lamp can be effectively perceived by a viewer.

The red light that is emitted by the light source unit preferably has a maximum value of light intensity at a wavelength of 615 nm or longer and 640 nm or shorter, and assuming that this maximum value of light intensity is 1, it is preferable that the light intensity at a wavelength of 600 nm is 0.1 or less, the light intensity at a wavelength of 670 nm is 0.1 or less, and the red light does not have a light intensity of 0.01 or greater at a wavelength of shorter than 600 nm and at a wavelength of longer than 670 nm.

The light that is emitted from the light source unit in the state of satisfying the conditions described above, does not contain light in a wavelength region other than the wavelength region of red light. This light makes the indicator lamp show a single vivid red color without color unevenness, in combination with the color tone of the light transmissive resin member, whereby the design of the indicator lamp is improved.

An example of such a light source for emitting red light includes a red light emitting diode (LED). Note that the LED light sources are provided in the necessary number in accordance with the shape and the area of the light transmissive resin member.

<Black Member>

The indicator lamp of the present invention preferably includes a black or dark black member.

The black member is provided to an inner wall surface of the lamp body, and it has light shielding characteristics as a whole and has a black achromatic color at least at a wall surface on the side where the light source unit is disposed.

Note that the black member may be a black inner wall surface that forms the lamp chamber of the lamp body.

Providing the black member to the indicator lamp allows a person viewing the indicator lamp, to observe the black member through the light transmissive resin member and enhances the black color tone, when the light source unit is turned off. Thus, in combination with jet-blackness of the light transmissive resin member itself, a step and a joint on the surface of the light transmissive resin member are less noticeable, and the indicator lamp itself is also less noticeable.

The black member is not specifically limited on the condition that it has a black color. In one example, a black synthetic resin that is black toned by mixing a publicly known colorant, such as carbon black, into a publicly known synthetic resin, or a black painted inner wall surface made of a publicly known metal sheet, can be used. Use of a black synthetic resin eliminates the need to paint black.

<Vehicle Indicator Lamp Vehicle Exterior Member>

The indicator lamp of the present invention can be suitably used as a vehicle indicator lamp, and the vehicle indicator lamp can be indirectly or directly provided to a vehicle by mounting it to a vehicle exterior member, such as a bumper or a rear gate.

EXAMPLES

The present invention will be detailed with reference to examples hereinafter, but the present invention should not be limited to the examples described below.

Example 1

(Production of Light Transmissive Resin Member)

The following transparent resin and the following colorant were supplied to a twin screw extruder (model name "PCM45", manufactured by Ikegai Corp.) so that the lightness (L*) would be 29.8 and the total light transmittance would be 6.5%, and they were kneaded at 250° C. Thus, pellets of a colored resin composite were obtained. The transparent resin was a methacrylic resin (methyl methacrylate (MMA)-methyl acrylate (MA) copolymer: ACRYPET (registered trademark) VH, manufactured by Mitsubishi Chemical Corp.). The colorant was a dye having a color index of Solvent Red 135 (wavelength at which the absorbance is maximum: 495 nm).

The obtained pellets of the colored resin composite were supplied to an injection molding machine (model name "N70A", manufactured by the Japan Steel Works, Ltd.) and were molded at a molding temperature of 260° C. into a plate of 2 mm in thickness, 100 mm in width, and 350 mm in length, whereby an outer cover (light transmissive resin member) was produced.

(Production of Vehicle Indicator Lamp)

An acrylonitrile-butadiene-styrene resin (ABS rein) that was mixed with carbon black was injection-molded, whereby a lamp body with a black inner wall surface having light shielding characteristics was obtained.

A red LED having a maximum value of light intensity at 625 nm as a light emitting characteristic, was disposed in the lamp chamber of the lamp body, and an opening of the lamp body was sealed with the outer cover, whereby a vehicle indicator lamp was produced.

Comparative Example 1

A vehicle indicator lamp was produced in the same manner as in Example 1 except that the following transparent resin and the following colorant were mixed so that the lightness (L*) would be 45.3 and the total light transmittance would be 15.6%. The transparent resin was a methacrylic resin (methyl methacrylate (MMA)-methyl acrylate (MA) copolymer: ACRYPET (registered trademark) VH, manufactured by Mitsubishi Chemical Corp.). The colorant was a dye having a color index of Solvent Red 135 (wavelength at which the absorbance is maximum: 495 nm).

Example 2

(Production of Light Transmissive Resin Member)

An outer cover (light transmissive resin member) was produced in the same manner as in Example 1 except that the following transparent resin and the following colorants were mixed so that the lightness (L*) would be 29.3 and the total light transmittance would be 6.4%. The transparent resin was a methacrylic resin (methyl methacrylate (MMA)-methyl acrylate (MA) copolymer: ACRYPET (registered trademark) VH, manufactured by Mitsubishi Chemical Corp.). The colorants were a dye having a color index of Solvent Red 179 (wavelength at which the absorbance is maximum: 475 nm) and a dye having a color index of Disperse Violet 28 (wavelength at which the absorbance is maximum: 555 nm).

(Production of Vehicle Indicator Lamp)

An acrylonitrile-butadiene-styrene resin (ABS rein) that was mixed with carbon black was injection-molded, whereby a lamp body with a black inner wall surface having light shielding characteristics was obtained.

A red LED having a maximum value of light intensity at 633 nm as a light emitting characteristic, was disposed in the lamp chamber of the lamp body, and an opening of the lamp body was sealed with the outer cover, whereby a vehicle indicator lamp was produced.

Example 3

A vehicle indicator lamp was produced in the same manner as in Example 2 except that the following transparent resin and the following colorants were mixed so that the lightness (L*) would be 26.6 and the total light transmittance would be 5.3%. The transparent resin was a methacrylic resin (methyl methacrylate (MMA)-methyl acrylate (MA) copolymer: ACRYPET (registered trademark) VH, manufactured by Mitsubishi Chemical Corp.). The colorants were a dye having a color index of Solvent Red 179 (wavelength at which the absorbance is maximum: 475 nm) and a dye having a color index of Disperse Violet 28 (wavelength at which the absorbance is maximum: 555 nm).

Comparative Example 2

A vehicle indicator lamp was obtained in the same manner as in Example 2 except that the following transparent resin and the following colorants were mixed so that the lightness (L*) would be 23.1 and the total light transmittance would be 4.1%. The transparent resin was a methacrylic resin (methyl methacrylate (MMA)-methyl acrylate (MA) copolymer: ACRYPET (registered trademark) VH, manufactured by Mitsubishi Chemical Corp.). The colorants were a dye having a color index of Solvent Red 179 (wavelength at which the absorbance is maximum: 475 nm) and a dye having a color index of Disperse Violet 28 (wavelength at which the absorbance is maximum: 555 nm).

<Evaluation>

The Examples 1 to 3 and the Comparative Examples 1 and 2 were evaluated by the following methods.

The light transmissive resin members were evaluated by preparing test pieces in accordance with the following method.

The results of evaluation are shown in Table 1.

(Preparation of Test Piece)

The obtained pellets of the colored resin composites of the Examples and the Comparative Examples were supplied to an injection molding machine (model name: IS-100, manufactured by Toshiba Machine Co., Ltd.) and were injection-molded at a molding temperature of 240° C. into sheet-shaped molded bodies (width of 50 min, length of 100 mm, and thickness of 2 mm).

These molded bodies were used as test pieces for evaluation.

(Measurement of Transmittance)

Light at a wavelength of 380 nm or longer and 780 nm or shorter was transmitted from a back surface of the test piece, and the transmitted light was measured from the surface of the test piece by using a spectrophotometer (model name "UV-3150"; manufactured by Shimadzu Corp.).

Figure 3:
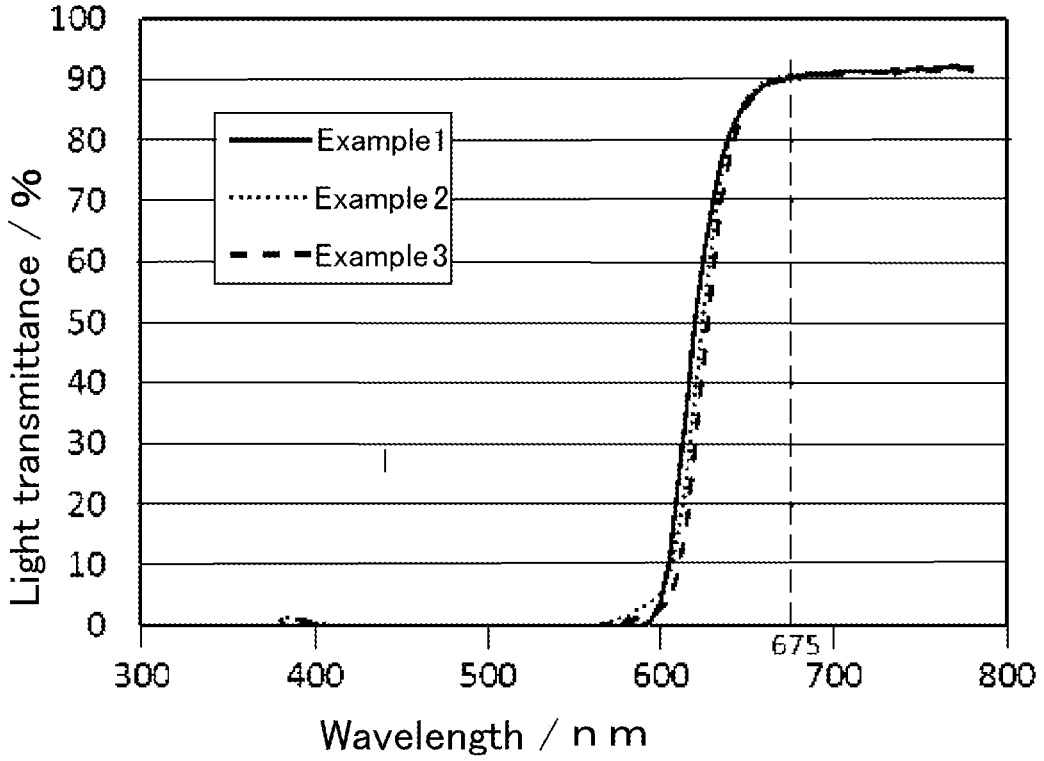
FIG. 3 is a graph illustrating a relationship between a light transmittance and a light wavelength of each of light transmissive resin members used in Examples 1 to 3.
Figure 4:
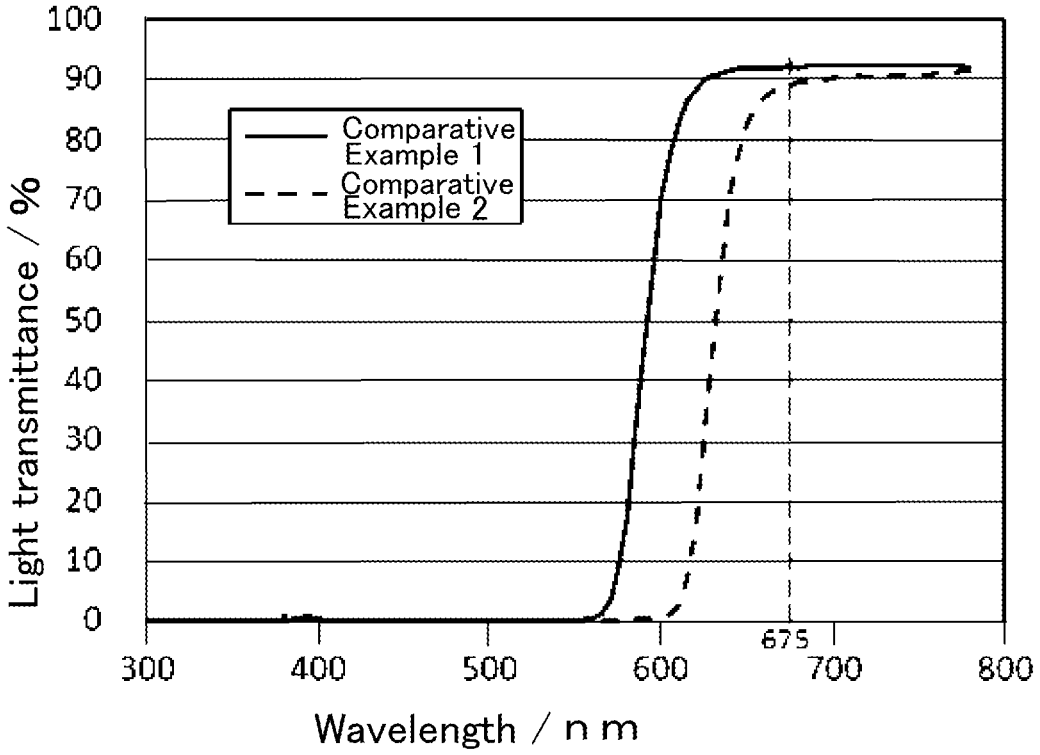
FIG. 4 is a graph illustrating a relationship between a light transmittance and a light wavelength of each of light transmissive resin members used in Comparative Examples 1 and 2.

The relationship between the light transmittance and the light wavelength of the light transmissive resin member of each of the Examples 1 to 3 is shown in FIG. 3. The relationship between the light transmittance and the light wavelength of each of the Comparative Examples 1 and 2 is shown in FIG. 4.

(Lightness (L*))

The lightness of the test piece was calculated from tristimulus values X, Y, and Z that were measured in conformity with ISO 11664-4 by transmittance measurement using a spectrophotometer (model name "UV-3150", manufactured by Shimadzu Corp.) in the condition of using a D65 light source and setting a viewing angle at 10 degrees. Note that the transmittance measurement was performed by integrating and receiving light with the use of an integrating sphere. The evaluation was performed by also using the following criterion.

(Total Light Transmittance)

The total light transmittance of the test piece was measured in conformity with ISO 13468-2 by using a spectrophotometer (model name "UV-3150", manufactured by Shimadzu Corp.).

The measurement was performed once on each of three test pieces, and an average of the three results was used as a total light transmittance (Tt). The evaluation was performed by further using the following criterion.

TABLE 1

| | Example | | | Comparative Example | |
|---|---|---|---|---|---|
| | 1 | 2 | 3 | 1 | 2 |
| Lightness (L*) | 29.8 | 29.3 | 26.6 | 45.3 | 23.1 |
| Total Light Transmittance (%) | 6.5 | 6.4 | 5.3 | 15.6 | 4.1 |
| $T_{600}$ (%) | 3.9 | 5.6 | 2.6 | 70.1 | 0.6 |
| $T_{610}$ (%) | 22.7 | 14.7 | 8.6 | 82.2 | 2.8 |
| $T_{625}$ (%) | 61.1 | 52.0 | 43.7 | 89.9 | 30.1 |
| $T_{675}$ (%) | 90.5 | 90.7 | 90.2 | 92.2 | 89.1 |
| Tα (%) | 0.1 | 1.8 | 1.3 | 17.9 | 1.1 |

(Design Evaluation)

The color tone of the vehicle indicator lamp when the light source was turned off and on was visually evaluated.

The vehicle indicator lamp of the Example 1 showed a red color tone when the light source was turned on and showed a black achromatic tone when the light source was turned off, whereby it had an excellent design.

Compared with the Example 1, the vehicle indicator lamps of the Examples 2 and 3 showed a vivid red color tone when the light source was turned on and showed a vivid black achromatic tone when the light source was turned off, whereby they had excellent designs.

The vehicle indicator lamp of the Comparative Example 1, in which the light transmissive resin member had a high lightness (L*) value, showed a red color also when the light source was turned off. Thus, a black achromatic tone was insufficient, and the design was unsatisfactory.

In the vehicle indicator lamp of the Comparative Example 2, the light transmissive resin member had a low transmittance of light having a wavelength of 675 nm and a low total light transmittance. Thus, brightness and a red color tone were insufficient when the light source was turned on, and the design was unsatisfactory.

INDUSTRIAL APPLICABILITY

The indicator lamp of the present invention and the vehicle indicator lamp including the indicator lamp have excellent designs and exhibit high brightness, whereby they can be suitably used in vehicle exterior members.

In particular, as to application of the vehicle indicator lamp, it can be suitably used as a vehicle light cover, such as a tail lamp cover or a head lamp cover, a pillar, or the like. Moreover, in the vehicle including the vehicle exterior member of the present invention, the vehicle indicator lamp shows its presence by showing a red chromatic tone when the light source is turned on, and conversely, it eliminates its presence by showing a black achromatic tone when the light source is turned off. Accordingly, when viewed straightly from a side of a viewer, the vehicle indicator lamp exhibits an unusual and original (attractive) appearance (look) and thus has an excellent design.

REFERENCE SIGNS LIST

1 Indicator lamp
2 Lamp body
3 Inner lens
4 Outer cover
5 Light source unit
1 Black member

The invention claimed is:

1. An indicator lamp comprising:

a lamp body;

a light source unit being disposed inside the lamp body; and a light transmissive resin member being disposed at a position for transmitting light that is emitted from the light source unit and for outputting the light from the lamp body, the light source unit being configured to emit red light having a maximum value of light intensity in a wavelength range of 600 to 700 nm, the light transmissive resin member having an L* value of 35 or less, a transmittance of light having a wavelength of 675 nm of 90% or greater in a state in which an optical path length of transmitting light is 2 mm, and a total light transmittance of 5% or greater in a state in which an optical path length of transmitting light is 2 mm.

2. The indicator lamp according to claim 1, wherein the light transmissive resin member has a total light transmittance of 6% or greater in the state in which an optical path length of transmitting light is 2 mm.

3. The indicator lamp according to claim 1, wherein the light transmissive resin member has a total light transmittance of 10% or less in the state in which an optical path length of transmitting light is 2 mm.

4. The indicator lamp according to claim 1, wherein the light transmissive resin member satisfies the following Formulas (1) to (3):

$$T_{600} \leq 10\% \quad \text{Formula (1)}$$

$$T_{610} \leq 25\% \quad \text{Formula (2)}$$

$$T_{\alpha} \leq 3.0\% \quad \text{Formula (3)}$$

wherein, in the Formulas (1) to (3), the symbols "$T_{600}$" and "$T_{610}$" represent light transmittances at wavelengths of 600 nm and 610 nm, respectively, and the symbol "$T_{\alpha}$" represents a maximum value of transmittance of light in a wavelength range of 380 nm or longer and shorter than 580 nm.

5. The indicator lamp according to claim 1, wherein the light source unit has a maximum value of light intensity in a wavelength region in which the transmittance of the light transmissive resin member is 60% or greater.

6. The indicator lamp according to claim 1, wherein the red light has a maximum value of light intensity at a wavelength of 615 nm or longer and 640 nm or shorter, and assuming that this maximum value of light intensity is 1, a light intensity at a wavelength of 600 nm is 0.1 or less, a light intensity at a wavelength of 670 nm is 0.1 or less, and the red light does not have a light intensity of 0.01 or greater at a wavelength of shorter than 600 nm and at a wavelength of longer than 670 nm.

7. The indicator lamp according to claim 6, wherein the light transmissive resin member satisfies the following Formula (4):

$$T_{625} \geq 45\% \quad \text{Formula (4)}$$

wherein, in the Formula (4), the symbol "$T_{625}$" represents a light transmittance at a wavelength of 625 nm.

8. The indicator lamp according to claim 1, wherein the light source unit is an LED.

9. The indicator lamp according to claim 1, wherein the light transmissive resin member contains transparent resin and at least two or more types of colorants having wavelengths that differ from each other in maximum absorbance value, and the transparent resin is at least one kind selected from methacrylic resin, polycarbonate resin, and polystyrene resin.

10. The indicator lamp according to claim 9, wherein the colorant includes at least one kind selected from a group consisting of anthraquinone dyes, perinone dyes, quinacridone dyes, methine dyes, azo dyes, and quinophthalone dyes.

11. The indicator lamp according to claim 1, further comprising:

an inner lens; and an outer cover, the inner lens and the outer cover being disposed so that the light that is emitted from the light source unit is transmitted through the inner lens and the outer cover, in this order, and is then output from the indicator lamp, the light transmissive resin member being the inner lens or the outer cover.

12. The indicator lamp according to claim 1, further comprising a black or dark black member, the black member being provided on an inner wall surface of the lamp body.

13. The indicator lamp according to claim 1, which is a vehicle indicator lamp.

14. A vehicle exterior member comprising the vehicle indicator lamp according to claim 13.

15. A vehicle comprising the vehicle indicator lamp according to claim 13.

* * * * *